United States Patent [19]

Gueret

[11] Patent Number: 4,954,000

[45] Date of Patent: Sep. 4, 1990

[54] REFILLABLE DISPENSER INCLUDING A TRANSLATABLE PLUNGER

[75] Inventor: Jean-Louis Gueret, Paris, France

[73] Assignee: L'Oreal, Paris, France

[21] Appl. No.: 338,226

[22] Filed: Apr. 14, 1989

[30] Foreign Application Priority Data

Apr. 15, 1988 [FR] France ..... 88 05026

[51] Int. Cl.[5] ..... A45D 40/06

[52] U.S. Cl. ..... 401/68; 401/70; 401/75; 401/172; 401/174; 401/182

[58] Field of Search ..... 401/171, 172, 174, 182, 401/68, 70, 75, 62

[56] References Cited

U.S. PATENT DOCUMENTS

| | | | |
|---|---|---|---|
| 1,362,937 | 12/1920 | Grace | 401/174 |
| 2,780,203 | 2/1957 | Moran et al. | 401/174 |
| 3,106,908 | 10/1963 | Gretz | 401/70 X |
| 3,358,699 | 12/1967 | Bau . | |

FOREIGN PATENT DOCUMENTS

| | | | |
|---|---|---|---|
| 0015784 | 9/1980 | European Pat. Off. . | |
| 1005717 | 4/1952 | France | 401/172 |
| 1343108 | 10/1963 | France . | |
| 2555471 | 5/1985 | France . | |
| 249650 | 7/1947 | Switzerland | 401/75 |
| 3243 | of 1913 | United Kingdom | 401/182 |
| 210979 | 2/1924 | United Kingdom | 401/75 |

*Primary Examiner*—Steven A. Bratlie

*Attorney, Agent, or Firm*—Cushman, Darby & Cushman

[57] ABSTRACT

The invention relates to a dispenser of a compact product (3) contained in a cylindrical reservoir (1); the product (3) is ejected via a plunger (4) that is displaceable in translation in the reservoir and is mounted at the end of a threaded rod (5), which cooperates with a nut (9). The rod (5) is driven in rotation incrementally via a pushbutton (8). The support (7) of the mechanism and of the nut (9) is movable with respect to the reservoir (1) by means of a thread. The nut (9) which cooperates with the rod (5) is slit along a diametrical plane, to allow the re-pressing of the rod when the half-nuts are capable of spreading apart. The reservoir includes a frustoconical surface 1c, which assures the pinching of the half-screws when the mechanism is put into place at the base of the full reservoir.

11 Claims, 3 Drawing Sheets

REFILLABLE DISPENSER INCLUDING A TRANSLATABLE PLUNGER

FIELD OF THE INVENTION

The present invention relates to a dispenser of a product, in particular a compact, solid or pasty product, which is pushed incrementally within a reservoir by a plunger subjected to translation controlled by the user. Such a dispenser may for example be used to dispense cosmetic products, in particular lipstick or a compacted powder.

BACKGROUND OF THE INVENTION

Dispensers of the above type are presently available on the market. In these dispensers, the plunger that pushes the product to be dispensed in the direction of the dispensing opening is controlled by a very complicated assembly: The plunger is mounted at the end of a threaded rod, which cooperates with a fixed nut integrally joined with the reservoir that contains the product; the threaded rod is displaceable to rotate by means of a mechanism that converts the action of the user upon the pushbutton of the dispenser into a rotation of slight angular amplitude; the rotation of the threaded rod, which cooperates with the aforementioned fixed nut, is converted into a translation of the rod with respect to the reservoir, by an amplitude that is smaller, the less the rotation of the rod becomes, on the one hand, and the smaller the pitch of the thread of the rod is, on the other. Thus for each action upon the pushbutton of the dispenser, a translation of the plunger by several hundredths of a millimeter is obtained, which is entirely satisfactory for dispensing the product. A dispenser of this type that is usable for a liquid product is described in particular in French Pat. No. 2 555 471.

However, the mechanism, which is disposed between the pushbutton and the plunger, is quite expensive, first because of the number of parts comprising it and second because of the complexity of molding the parts, and finally because of the difficulty of assembling this mechanism. The function of such a mechanism is irreversible; when the plunger gets close to the dispensing opening of the reservoir, it cannot be moved backward for refilling the reservoir, because the only possibility of backward travel would be a reverse screwing of the threaded rod in its nut, which is certainly not within the ability of the user to accomplish. The mechanism of such a dispenser must therefore be considered disposable, since it is not reusable when the reservoir is empty, and the cost for such a mechanism greatly increases the cost price of the dispenser filled with the product to be dispensed. For dispensing cosmetic products, since the total volume of the dispenser must be reduced to permit the user to carry it about easily, for instance in a handbag, the reservoir is necessarily of reduced capacity, and consequently the elevated cost of the mechanism raises the price of a small-capacity package; this is particularly unfavorable at the commercial level.

SUMMARY OF THE INVENTION

The object of the invention is to propose a dispenser of the above described type, in which the reservoir is interchangeable. In other words, it is proposed that the expensive portion of the package be reused with refills, which make it possible to amortize the relatively high cost of the mechanism over the dispensing of a larger quantity of product. The invention accordingly provides a dispenser with two sub-assemblies, one of which includes the mechanism, its pushbutton for control and the pusher plunger controlled by the threaded rod of the mechanism, and the other sub-assembly includes the reservoir of the product to be dispensed; the plunger of the first sub-assembly penetrates the reservoir and the second sub-assembly is integrally joined in a movable manner to the first sub-assembly. Accordingly, by comparison with the state of the art, it is necessary to permit a disengagement of the threaded rod, which cooperates with the fixed nut of the mechanism, to enable this threaded rod, when it has arrived at a fully projected position for the complete dispensing of the dose contained in a first reservoir, to be reinserted into the mechanism, in order to return the plunger into the position corresponding to the onset of dispensing of the product contained in a full reservoir. It should be noted that the plunger is not necessarily integrally joined to the threaded rod that causes its translation, and that it may be mounted movably on this threaded rod; in that case, the plunger may be located in the second sub-assembly and may comprise the bottom of the reservoir containing the product to be dispensed. Such a plunger placed in the refill reservoir may include means for retaining the product to be dispensed when the product is compact, for example when it is a lipstick; however, if the product is a liquid, the plunger may simply comprise an internal cap, which closes the reservoir on the side on which the dispensing orifice is not located.

To attain this object, the invention proposes that the nut which cooperates with the threaded rod be slit along a diametrical plane, such as to permit it to open, in the threaded zone where it cooperates with the threaded rod, when the two half-nuts comprising the slit are not constrained by one another. To make the second sub-assembly, the reservoir is integrally joined to a sleeve that comes to cover the nut and includes a conical surface assuring the locking of the two half-nuts with one another when the second sub-assembly is made integral with the first; in that position, the threaded rod meshes with the threading of the nut. Contrarily, when the second sub-assembly is disengaged from the first sub-assembly, the two half-nuts are not pushed against one another, and in that case any axial thrust exerted upon the plunger presses the threaded rod between the two half-nuts, which spread slightly apart to permit its passage, the threads of the rod rubbing against the threads of the half-nuts. It can thus be seen that when a new reservoir comes to be put into use, after all the product contained in one reservoir has been dispensed, the plunger will abut against the rear limit face of the product to be dispensed contained in the new reservoir, when this new reservoir is put in place on the mechanism. The action of this stop makes the plunger recoil toward the mechanism when the reservoir is displaced in the direction in which the mechanism is moved to put it into its place; this recoil of the plunger takes place until its initial placement in position, and at that moment the conical surface of the reservoir assures the interlocking of the two half-nuts, which puts the threaded rod back into engagement with the nut and makes possible the beginning of a new cycle of dispensing of the product contained in the new reservoir that has been put into place. When the product to be dispensed is a compact, solid or pasty product, the rear limit face on which the plunger is supported while the new reservoir is put into place comprises the limit plane for filling of the product, and the dispensing opening may be of any kind. If the product to be dispensed is liquid, the dispensing opening has a small cross section or is comprised by a porous element such as a point, and the rear limit face may be a cap that can be torn away or displaced by the plunger. It should be noted that the dispensing opening may also comprise a tufted socket or an appendage in the form of a brush or foam rubber or a tufted applicator. Moreover, as indicated above, when the product to be dispensed is liquid, the plunger may itself comprise the cap defining the rear limit face of the product with which the reservoir is filled. When the plunger is used to comprise the rear limit face of the product in the reservoir, and this product is liquid or compact, it may be put into place in the reservoir via one or the other of the ends depending on how the dispensing opening is comprised; in certain cases, a bead may be provided behind the plunger to limit its course.

It should be noted that the same mechanism can be used not only to successively dispense the contents of a plurality of reservoirs filled with the same product to be dispensed, but also for dispensing different products contained in different reservoirs, such as lipstick, compacted powder or others.

Consequently, the subject of the present invention is a novel industrial product that comprises a dispenser of a product contained in a cylindrical reservoir of any cross section, in which the product is disposed between the dispensing opening and a plunger displaceable in translation in the reservoir, the plunger being mounted at the end of a threaded rod which cooperates with a fixed nut supported by a support integrally joined with the reservoir, the threaded rod being displaceable in rotation incrementally by means of a mechanism also supported by the support, this movement being initiated by the action of the user upon a displaceable maneuvering device supported by the support, in order to obtain the translation of the plunger and the dispensing of the product, characterized in that:

(a) the support of the mechanism and of the nut includes a means for integral connection with the reservoir permitting movability of the reservoir with respect to the support;

(b) the nut that cooperates with the threaded rod is slit along at least one diametrical plane over the entire length of its threaded hole, the sectors of the nut being held together by a flexible zone which assures the fixation of the nut on the support;

(c) the reservoir includes a frustoconical surface, which comes to be pressed against a corresponding frustoconical surface of the nut and/or of the support, when the movable reservoir is integrally joined with the support to assure the pinching of the sectors of the nut about the threaded rod driven by the mechanism.

In a preferred embodiment, the maneuvering device of the mechanism is a pushbutton disposed on the part of the dispenser that is opposite the dispensing opening; the nut is slit along a single diametrical plane and is fixed to one end of the support by racheting.

In an advantageous embodiment, the reservoir and the support have a cylindrical shape of circular cross section. In that case, the means for integrally joining the reservoir with the support may be a screwing means, and the reservoir can then comprise two cylindrical portions of different inside diameters, connected to one another via the frustoconical surface, which assures the pinching of the nut sectors, the portion having the smaller diameter closing off the product to be dispensed and the other comprising a sheath which clasps the support, the sheath carrying a thread at its free end which cooperates with a thread carried by the end of the support where the maneuvering device is disposed. The second sub-assembly of the dispenser is accordingly called generally the "reservoir"; this "reservoir" comprises a reservoir portion where the product is located and a sleeve, which is formed by the frustoconical portion and the sheath that are mentioned above.

According to an important embodiment, the nut engages one end of the support and is fixed in it by racheting tabs, one end of the nut remaining outside the support and forming the frustoconical surface which cooperates with that of the reservoir; the nut includes two racheting tabs, the center lines of which are in the diametrical plane along which the nut is slit.

To facilitate the spreading apart of the nut sectors at the moment when the threaded rod is reintroduced inside the mechanism, when a new reservoir is put into place, it is desirable to reduce the rigidity of the flexible zone of the nut, which is located between the fixation of the nut to the support and the threaded portion. To do this, it may be provided that the slit of the nut, at the level of its thread, opens on either side of the nut into a peripheral slit, which extends over less than 180° to allow a side wall zone to remain, forming the flexible zone of the nut and connecting the threaded portion with the means for fixation of the nut to the support. When the nut engages one end of the support, it is preferable for the rigidity of the end of the support that clasps the nut also to be reduced, in such a manner that the side wall of the support does not itself present an obstacle to the spreading apart of the nut sectors; to this end, it may be provided that the racheting tabs of the nut carry the male portions of the rachet mechanism, their center lines being in the diametrical plane of the slit of the nut, and the support carries recesses comprising the female portions of the rachet mechanism, one axial and one peripheral slit opening into each female portion, and the peripheral slit extending symmetrically on either side of the female portion over less than 90°. Although the dispenser according to the invention may be used with any mechanism making it possible to obtain an incremental rotation of the threaded rod, the invention may advantageously be used with a known mechanism, which inside the support includes the following:

(a) a driver integrally joined with the pushbutton, guided in translation in the support via grooves and crenelated in a V shape on its edge opposite the pushbutton, the driver being pushed by a restoring spring against a stop of the support;

(b) a barrel with peripheral fins that are radial and parallel to the axis of the barrel, the barrel being traversed along its axis by the threaded rod of the mechanism, the rod having at least one flattened face and traversing the barrel via a hole having the same cross section, such that any rotation of the barrel causes a rotation of the rod, the fins of the barrel having ends that are oblique with respect to the axis of the barrel, facing the crenelations of the driver, the restoring spring which acts upon the driver being disposed between the barrel and the end of the support that is opposite the pushbutton;

(c) a sawtooth relief, which cooperates with the oblique ends of the fins and comprises a stop for the fins, projecting from the inside wall of the support, the crenelations of the driver having the same angular spacing as the sawteeth, but the tops of the crenelations being offset angularly with respect to the tops of the sawteeth.

Aside from the various advantages described above, the dispenser according to the invention permits an improvement in terms of usage by the user. In dispensers of the prior art, the reservoir is generally not filled flush to the edge, to prevent it from overflowing at the time of filling, taking tolerances for filling into account. When the mechanism is put into place, the plunger is at the low end of its course; as a result, to begin dispensing, the mechanism must be maneuvered a great number of times to cause the product to be dispensed, by translation of the plunger, to emerge from the dispenser opening. In an existing commercial embodiment including a pushbutton and assuring the dispensing of lipstick, for instance, the pushbutton must be actuated about 20 times before the lipstick emerges and can be used. In the device according to the invention, this disadvantage may be avoided for any emplacement of a product refill as soon as the dispensing opening generates an important pressure drop; in fact, when the pressing of the threaded rod between the nut sectors is brought about, it is sufficient to assure adequate friction so that during this pressing the plunger will be pushed toward the dispenser opening until the product is flush with the dispenser opening; later emergence of the product is prevented by the great pressure drop in the dispensing opening itself. It can thus be seen that when the refill is put into place on the mechanism, the apparatus is now ready for use without any need for some starting procedure.

For better understanding the subject of the invention, an exemplary embodiment will now be described in detail, referring to the accompanying drawings.

DESCRIPTION OF THE PREFERRED EMBODIMENTS

Figure 1:
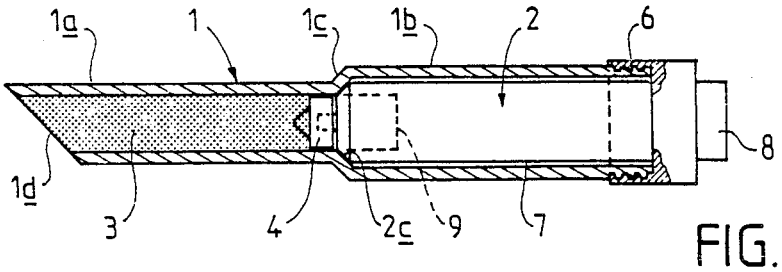
FIG. 1 is a schematic sectional view of a dispenser according to the invention in the position corresponding to the beginning of dispensing of the product with which the reservoir is filled.
Figure 2:
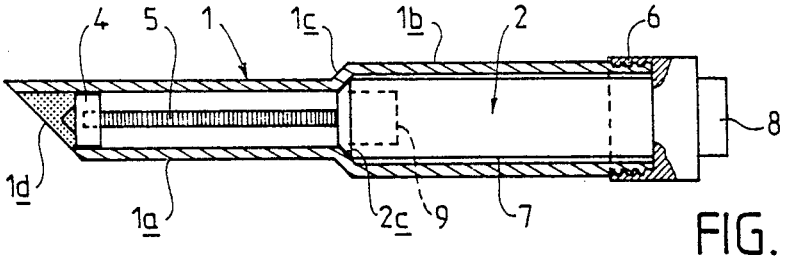
FIG. 2 shows the dispenser of FIG. 1 in the position corresponding to the end of dispensing of the product contained in the reservoir.
Figure 3:
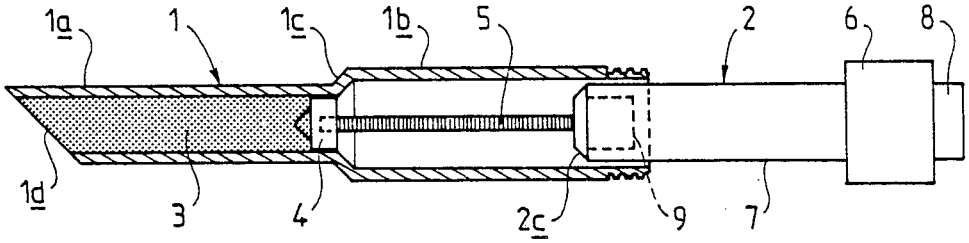
FIG. 3 illustrates how a new full reservoir is put into place on the mechanism of the dispenser in the position that it has attained in FIG. 2.

Turning now to FIGS. 1–3, it can be seen that the dispenser according to the invention comprises two sub-assemblies: The first sub-assembly is a reservoir 1, and the second sub-assembly is identified as element 2 and includes a mechanism.

The reservoir 1 has a generally cylindrical shape; it comprises two cylindrical portions 1*a* and 1*b* of circular cross section and having different inside diameters, connected to one another via a frustoconical portion 1*c*. The portion 1*a* contains the product 3 to be dispensed; it may for example be lipstick. The portion 1*b* comprises a sheath, which clasps the sub-assembly 2. The frustoconical portion 1*c* comprises a frustoconical surface on its inside which cooperates with a corresponding frustoconical surface 2*c* of the sub-assembly 2.

Figure 6:
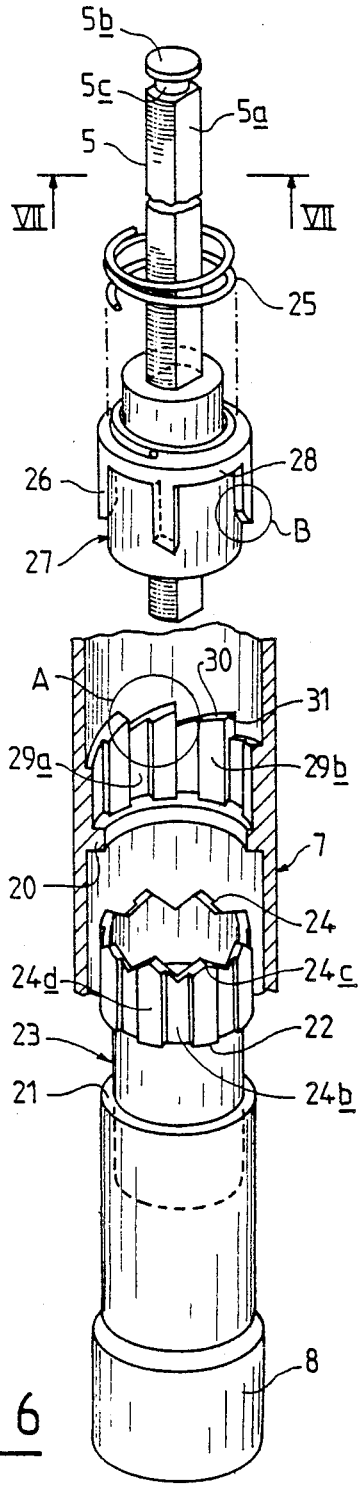
FIG. 6 is an exploded perspective view of the various constituent parts of the mechanism.
Figure 7:
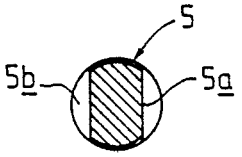
FIG. 7 is a section of the threaded rod taken along the line VII—VII of FIG. 6.
Figure 8:
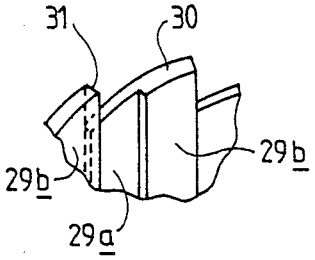
FIG. 8 is a perspective view of the detail marked A in FIG. 6.
Figure 9:
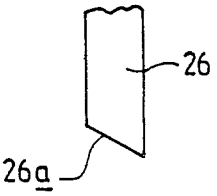
FIG. 9 is a view of the detail marked B in FIG. 6.

On the side toward the product 3 to be dispensed, the sub-assembly 2 includes a plunger 4, which is mounted at the end of a threaded rod 5, the cross section of which includes 2 flat sides 5*a* diametrically opposite one another. The end of the rod 5 forms a circular plateau 5*b* having the diameter of the rod 5. The plateau 5*b* is separated from the threaded portion of the rod 5 by a throat 5*c*, by means of which the plunger 4 is affixed to the end of the rod 5 by racheting (FIGS. 6 and 7). Disposed at the base of the sub-assembly 2 is a skirt 6 threaded on the inside, which surrounds the base of a cylindrical tube 7 that comprises the support of the dispenser mechanism. The free end of the cylindrical portion 1*b* is threaded on the outside to enable it to cooperate with the internal thread carried by the skirt 6, which makes it possible to affix the reservoir 1 to the sub-assembly 2.

At the base of the sub-assembly 2 is a pushbutton 8, which when pressed makes it possible, via a mechanism to be described hereinafter, to obtain a rotation by an angular increment of the threaded rod 5. Located at the top of the support 7 is a nut 9, which is shown in detail in FIG. 4, and with which the threaded rod 5 cooperates. When the user presses on the pushbutton 8, this causes a rotation of the threaded rod 5 in the nut 9, and hence a displacement of the threaded rod with respect to the reservoir 1; the plunger 4 is then displaced from the base to the open end 1*d* of the reservoir 1, which enables it to expel the product 3 from the reservoir where it is packaged; this dispensation takes place incrementally, with each increment being of very slight amplitude, because of the gearing down between the translation of the pushbutton 8 and that of the plunger 4 that is obtainable because of the mechanism of the sub-assembly 2.

Figure 4:
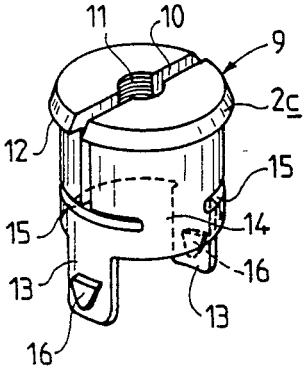
FIG. 4 is a perspective view of the slit nut of the mechanism of the dispenser of FIGS. 1–3.
Figure 5:
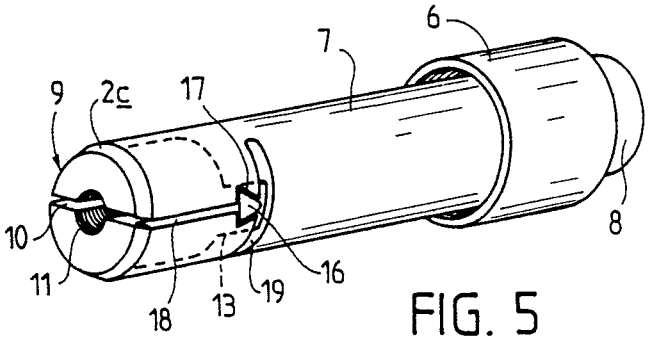
FIG. 5 is a perspective view of the support of the mechanism and of the nut, the nut being put into place at the head of the support and the threaded rod having been raised for better reading of the drawing, and the reservoir not being fixed to the support of the mechanism.

The nut 9 of the dispenser that has been described above has a particular structure shown in detail in FIG. 4. It is slit along a diametrical plane, the slit 10 thus made extending over the entire height of the threaded hole 11 of the nut. This threaded portion is limited on one side by a plateau 12, the edge of which comprises the frustoconical surface 2*c*, and it is connected on the other side to two fixation tabs 13, via a flexible zone 14. The flexible zone 14 is a cylindrical wall of slight width and slight thickness, which is defined on either side by two peripheral slits 15, each extending over slightly less than 180°, symmetrically with respect to a diametrical plane perpendicular to that of the slit 10. The center lines of the tabs 13 are located in the plane of the slit 10; each of the tabs 13, in the vicinity of their free end, includes a boss 16 intended to latch in a recess of corresponding shape 17 made in the wall of the support 7.

The support 7 has the shape of a cylindrical tube of circular cross section; its end opposite the pushbutton 8 receives the nut 9 in such a manner that the plateau 12 presses in the manner of a lid projecting from the end of the support 7. The end of the support 7 that encloses the nut 9 is slit along two generatrices vertically of the recesses 17, which produces two axial slits 18. A peripheral slit 19 extending over less than 90° is also provided on either side of this recess 17. The presence of the slits 18 and 19 in the wall of the support 7 where the nut 9 is inserted makes it easy to spread apart the two portions of this cylindrical wall separated by the slit 18; in this way, the wall of the support 7 does not prevent the spreading apart of the two nut sectors or half-nuts separated by the slit 10. In other words, the wall of the support 7 has been made deformable because of the slits 19, in the same manner as the zone 14 was made flexible by the provision of the slits 15. As a result, under the influence of even slight strain, the two half-nuts separated by the slit 10 can spread apart. A slight play has been provided between the support 7 and the cylindrical portion **1*b*** to permit this spreading apart.

When the first sub-assembly 2 has been used for the complete emptying of one reservoir 1, as shown in FIG. 2, the reservoir 1 is unscrewed to detach it from the skirt 6, and is replaced with a new full reservoir, as shown in FIG. 3. The rod 5 has emerged completely from the support 7, and at the moment when the support 7 engages the cylindrical portion **1*b*, the plunger 4 comes to rest against the rear face of the product 3 packaged in the reservoir. If the support 7 is forced farther forward in the cylindrical portion 1*b* to engage it, the thread of the rod 5 causes the spreading apart of the two half-nuts that are separated by the slit 10, since nothing confines these two half-nuts with respect to one another, and they can spread apart from the action of the axial thrust that is transformed into a spreading force by the contact of the threads of the rods 5 with the threads of the threaded hole 11. The rod 5 then slides with friction in the nut 9, until it returns to the position it occupied in FIG. 1, that is, the position in which it is completely retracted inside the support 7, the plunger 4 substantially pressing on the plateau 12 of the nut 9. When this position has been attained, the frustoconical surface 1*c* presses against the frustoconical surface 2*c* of the plateau 12, which causes the two half-nuts to be locked in position so that they can no longer spread apart. The threads of the hole 11 thus again mesh with those of the threaded rod 5, which makes it possible, if a rotation of the threaded rod 5 is brought about by the mechanism contained in the support 7, to drive this rod in translation with respect to the reservoir and hence to dispense the product 3**.

It can accordingly be seen that by means of the device described above, the first sub-assembly 2 can be reused to dispense the product contained in a plurality of reservoirs that are successively appended to the same sub-assembly 2. In this way, the dispenser in question becomes valuable and exploitable commercially, since the elevated cost of the sub-assembly 2 can be amortized over the dispensing of the product contained in a plurality of reservoirs.

In FIGS. 6–17, the mechanism contained in the support 7 has been schematically described. This mechanism is of a known type (see in particular French Patent No. 2 555 471); each time the pushbutton 8 is pressed upon, it causes a displacement of the plunger 4 by a few hundredths of a millimeter.

In FIG. 6, it can be seen that the support 7 includes an annular stop 20 on its inside, which cooperates at its lower edge with the upper edge 21 of the pushbutton 8, and with its upper edge cooperates with the lower collar 22 of a driver 23 wedged with force in the pushbutton 8 to be integrally joined with it. Below the collar 22, the driver 23 includes a cylindrical zone, the upper edge 24 of which is crenelated in a V pattern; the edge 24 has eight V-shaped tops. As will be explained below, the driver 23 is subjected to the action of a restoring spring 25, which tends to cause the pushbutton 8 to protrude toward the outside and consequently to press the collar 22 against the annular stop 20. When the user presses on the pushbutton, the pressing of the pushbutton 8 takes place until the edge 21 comes to a stop against the inside face of the annular stop 20. The distance between the collar 22 and the edge 21 then defines the course of the pushbutton 8.

Straight ahead of the driver 23 is a barrel 27 which includes four fins 26 projecting from its periphery and oriented radially and parallel to the axis of the barrel 27. The lower end **26*a* of these fins 26 is chamfered, as is clearly seen in FIG. 9; the obliquity of the ends 26*a* with respect to the common axis of the barrel 27 and driver 23 is the same as that of the apexes of the V of the edge 24. At the upper portion of the barrel 27 there is a plateau 28, on which the spring 25 of the mechanism comes to be supported, the other end of the spring 25 being supported on the lower edge of the nut 9, that is, on a face of the nut 9 that is opposite the plateau 12. The ends 26*a* of the fins 26 are thus pushed in the direction of the edge 24**.

On the inside face of its side wall, the support 7 includes a sawtoothed relief above the annular stop 20. The sawteeth include oblique ridges 30, the obliquity of which with respect to the axis of the support 7 is equal to that of the ridges of the V of the rim 24. There are eight ridges; the tops 31 of each sawtooth are connected to the annular stop 20 via ridges that are parallel to the generatrices of the support 7, and each sawtooth is divided into two portions of equal width: one portion **29*a* forming a low relief with respect to the wall of the support 7, and one portion 29*b*** forming a higher relief.

If the angular pitch of a sawtooth is called P, then it can be found that the crenelated edge 24 has crenelations separated by the same angular pitch, but the tops **24*c* of the V crenelations of the edge 24 are offset by P/4 with respect to the top 31. The width of the fins 26** equals P/2.

On the outside, the portion of the driver 23 that is above the collar 22, has ribs **24*d* having a width of P/2, two ribs being separated from one another by one groove 24*b* having a width of P/2, the ribs being disposed vertically of the tops 24*c* of the crenelated edge 24**, symmetrically with respect to the generatrix passing along each of these tops.

Figure 10:
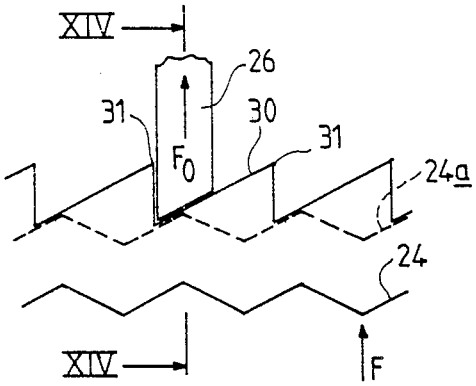
FIGS. 10–13 are kinematic diagrams illustrating the functioning of the mechanism.
Figure 11:
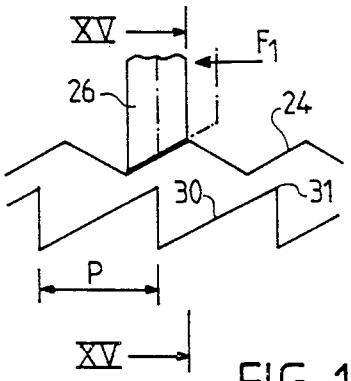
Figure 12:
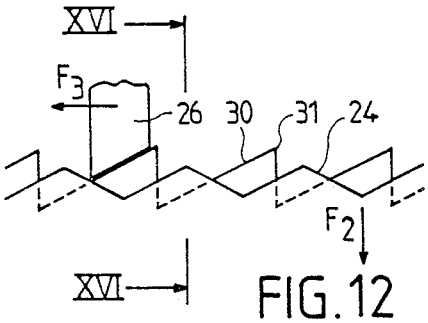

FIGS. 10–13 are kinematic diagrams of the functioning of this mechanism. In FIG. 10, it can be seen that the crenelated edge 24 is pushed upward in accordance with the arrow F by the pushbutton 8, to arrive at the position **24*a* shown in dashed lines. The fins 26 are in contact with the bottom points of the sawteeth. When the crenelated edge arrives in the position 24*a*, it begins to raise the fin 26 along the arrow F0, and this raising continues until the bottom ridge of the fin 26 arrives at the level of the ridge 31. As soon as this level been exceeded, the spring 25, pushing on the fin 26, causes it to rotate in the direction of the arrow Fl (FIG. 11), and the fin 26, which initially was in the position with respect to the edge 24 shown in dot-dash lines in FIG. 11, rotates to arrive at the position shown in solid lines, where its lower ridge is located at the bottom of the V crenelation, which was the closest to its initial position. If the pressure on the pushbutton 8 is then relaxed, the fin 26 contacting the crenelated edge 24 drops down again in accordance with the arrow F2 (FIG. 12), and the fin 26 again comes into contact with an oblique face 30 of the sawtoothed edge; in proportion to the displacement along the arrow F2 of the crenelated edge 24, the fin 26 begins to displace in rotation in the direction of the arrow F3; when the crenelated edge 24 passes completely below the sawtoothed profile, via a displacement along the arrow F5 (see FIG. 13), the fin 26** is displaced by a stroke along the arrow F4 until its lower ridge is at the lower point of one sawtooth.

Figure 13:
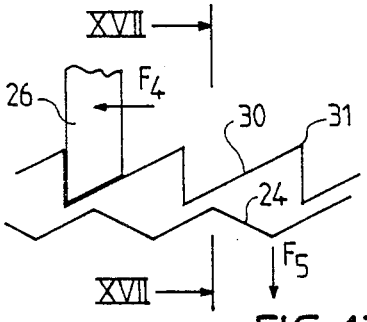
Figure 14:
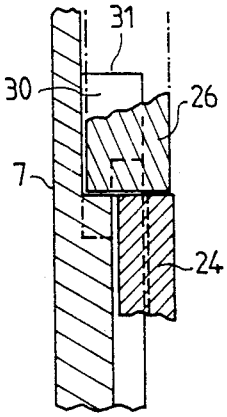
FIGS. 14–17 represent sectional views carrying reference numerals corresponding to FIGS. 10–13, respectively.
Figure 15:
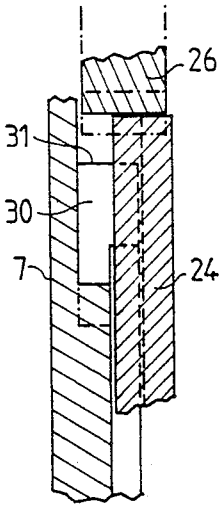
Figure 16:
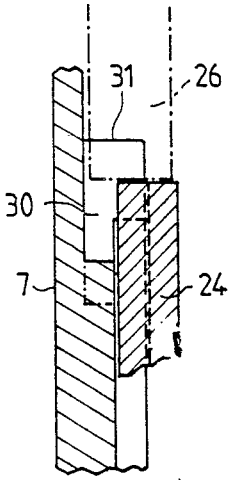
Figure 17:
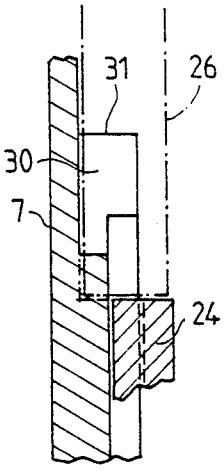

It can thus be seen that the displacement of the fin 26 is brought about in three periods of time: first, a first rotation undergone from P/4 until the moment when the crenelated profile 24 passes above the sawtoothed profile 30 (FIG. 11); second, a progressive rotation from P/2 in the course of the descent of the crenelated portion 24 (FIG. 12); and finally, a rotation undergone from P/4 when the crenelated portion 24 passes below the sawtoothed profile 30 (FIG. 13).

For an operation of thrust upon the pushbutton 8, a rotation of the barrel is thus obtained equal to an angular pitch P. Since the threaded rod 5 traverses the barrel 27 via an opening the cross section of which is equal to that of the threaded rod, any rotation of the barrel 27, because of the presence of the flat edges 5*a* on the threaded rod 5, causes a rotation of equal value of the threaded rod. In other words, the threaded rod rotates by one increment P upon each action exerted upon the pushbutton, or in other words by one-eighth of a rotation. Since the pitch of the threading of the rod 5 may be approximately one-half a millimeter, it can be seen that each action upon the pushbutton causes a displacement of the rod by approximately 0.06 mm.

FIGS. 14–17 are reference sectional views corresponding to FIGS. 10–13, respectively, in which the positions of the fin 26 in front of the plane of the drawing have been shown in dot-dash lines.

It will be understood that the embodiment described above is in no way limiting and lends itself to any desirable modification, without departing from the scope of the invention.

What is claimed is:

1. A dispenser of a product (3) contained in a cylindrical reservoir (1) in which said product (3) is disposed between the dispensing opening (1*d*) and a plunger (4) displaceable in translation in the reservoir (1), the plunger (4) being mounted at the end of a threaded rod (5) which cooperates with a fixed nut (9) supported by a support (7) integrally joined with the reservoir (1), the threaded rod (5) being displaceable in rotation incrementally by means of a mechanism also supported by said support (7), this movement being initiated by the action of the user upon a displaceable maneuvering device (8) supported by the support (7), in order to obtain the translation of the plunger (4) and the dispensing of the product (3)

the said dispenser comprising two sub-assemblies, the first sub-assembly including the mechanism, the threaded rod (5), the nut (9), the maneuvering device (8), the support (7) and the plunger (4), the second sub-assembly being the reservoir (1), and the first sub-assembly being joined in a removable manner to the second sub-assembly by connecting means (6);

the nut (9) that cooperates with the threaded rod (5) is slit along at least one diametrical plane over the entire length of its threaded hole (11), the sectors of the nut being held together by a flexible zone (14) which assures the fixation of the nut (9) on the support (7);

the reservoir (1) includes a frustoconical surface (1*c*), which comes to be pressed against a corresponding frustoconical surface (2*c*) of the nut (9), when the movable reservoir (1) is joined with the support (7) to assure the pinching of the sectors of the nut about the threaded rod (5) driven by the mechanism.

2. A dispenser as defined by claim 1, characterized in that the maneuvering device of the mechanism is a pushbutton (8) disposed on the part of the dispenser that is opposite the dispensing opening (1*d*).

3. A dispenser as defined by claim 1, characterized in that the nut (9) is slit along a single diametrical plane and is fixed to one end of the support (7) by racheting.

4. A dispenser as defined by claim 1, characterized in that the reservoir (1) and the support (7) have a cylindrical shape of circular cross section.

5. A dispenser as defined by claim 4, characterized in that the means for integral joining with the reservoir (1) on the support (7) is a screwing means.

6. A dispenser as defined by claim 5, characterized in that the reservoir (1) comprises two cylindrical portions (1*a*, 1*b*) of different interior diameters connected to one another via the frustoconical portion (1*c*) which assures the pinching of the sectors of the nut, the portion (1*a*) of the smallest diameter closing the product (3) to be dispensed and the other (1*b*) comprising a sheath, which clasps the support (7), said sheath carrying a thread at its free end which cooperates with a thread carried by the end of the support (7) where the maneuvering device (8) is disposed.

7. A dispenser as defined by claim 4, characterized in that the nut (9) is engaged in one end of the support (7) at its fixed variant by racheting tabs (13), one end of the nut (9) remaining outside the support and forming the frustoconical surface (2*c*) which cooperates with that (1*c*) of the reservoir (1).

8. A dispenser as defined by claim 7, characterized in that the nut (9) has two racheting tabs (13), the center lines of which are in the diametrical plane along which the nut (9) is slit.

9. A dispenser as defined by claim 3, characterized in that the slit (10) of the nut (9), at the level of its thread, discharges on either side of the nut (9) in a peripheral slit (15), which extends over less than 180° to allow a side wall zone to remain, forming the flexible zone (14) of the nut (9) and connecting the threaded portion with the means for fixation of the nut (9) to the support (7).

10. A dispenser as defined by claim 8, characterized in that the racheting tabs (13) of the nut (9) carry the male portions (16) of the rachet mechanism, their center lines being in the diametrical plane of the slit of the nut (9), and the support carries recesses (17) comprising the female portions of the rachet mechanism, one axial (18) and one peripheral slit (19) opening into each female portion (17), and the peripheral slit (19) extending symmetrically on either side of said female portion over less than 90°.

11. A dispenser as defined by claim 1, characterized in that inside the support (7), the mechanism includes:

(a) a driver (23) integrally joined with the pushbutton (8), guided in translation in the support (7) via grooves and crenelated in a V shape on its edge (24) opposite the pushbutton (8), said driver (23) being pushed by a restoring spring (25) against a stop (20) of the support (7);

(b) a barrel (27) with peripheral fins (26) that are radial and parallel to the axis of the barrel, the barrel (27) being traversed along its axis by the threaded rod (5) of the mechanism, said rod carrying at least one flattened face and traversing the barrel (27) via a hole having the same cross section as the rod, such that any rotation of the barrel (27) causes a rotation of the rod (5), the fins (26) of the barrel (27) having ends (26*a*) that are oblique with respect to the axis of the barrel (27), facing the crenelations of the driver (23), the restoring spring (25) which acts upon the driver (23) being disposed between the barrel (27) and the end of the support (7) that is opposite the pushbutton (8);

(c) a sawtooth relief (30), which cooperates with the oblique ends (26*a*) of the fins (26) and comprises a stop for the fins, projecting from the inside wall of the support (7), the crenelations of the driver (23) having the same angular spacing as the sawteeth, but the tops of the crenelations being offset angularly with respect to the tops (31) of the sawteeth (30).

* * * * *